US007455205B2

(12) United States Patent
Pally et al.

(10) Patent No.: US 7,455,205 B2
(45) Date of Patent: Nov. 25, 2008

(54) MAGAZINING DEVICE FOR A DRIVE-IN POWER TOOL

(75) Inventors: Andreas Pally, Reussbuehl (CH); Gerd Daubinger, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 904 days.

(21) Appl. No.: 11/001,842

(22) Filed: Dec. 2, 2004

(65) Prior Publication Data

US 2005/0224379 A1 Oct. 13, 2005

(30) Foreign Application Priority Data

Dec. 4, 2003 (DE) ..... 103 56 548

(51) Int. Cl.
*B25C 1/00* (2006.01)

(52) U.S. Cl. ..... 227/120; 227/8; 227/136

(58) Field of Classification Search ..... 227/120, 227/8, 135, 136, 119, 109, 10
See application file for complete search history.

(56) References Cited

U.S. PATENT DOCUMENTS

| | | | | | |
|---|---|---|---|---|---|
| 3,266,697 | A * | 8/1966 | Fiedler | 227/120 |
| 3,905,535 | A | 9/1975 | Novak et al. | |
| 4,304,349 | A * | 12/1981 | Novak et al. | 227/109 |
| 4,389,012 | A * | 6/1983 | Grikis et al. | 227/120 |
| 5,180,091 | A * | 1/1993 | Ota | 227/8 |
| 5,597,972 | A * | 1/1997 | Wachter | 89/1.14 |
| 5,829,661 | A * | 11/1998 | Hirtl et al. | 227/10 |
| 5,975,399 | A | 11/1999 | Oehri et al. | |
| 6,053,389 | A | 4/2000 | Chu et al. | |
| 6,237,747 | B1 * | 5/2001 | Gantner et al. | 198/747 |
| 6,454,152 | B1 * | 9/2002 | Nayrac et al. | 227/120 |
| 6,592,016 | B2 * | 7/2003 | Hamano et al. | 227/119 |
| 6,685,078 | B2 * | 2/2004 | Wohlwend et al. | 227/120 |
| 6,834,788 | B2 * | 12/2004 | Popovich et al. | 227/127 |
| 7,172,103 | B2 * | 2/2007 | Fujiyama et al. | 227/120 |

FOREIGN PATENT DOCUMENTS

| | | |
|---|---|---|
| DE | 2238105 | 2/1974 |
| DE | 2240332 | 2/1974 |
| DE | 9505437 | 9/1995 |
| GB | 1463144 | 2/1977 |

* cited by examiner

*Primary Examiner*—Scott A. Smith
(74) *Attorney, Agent, or Firm*—Abelman, Frayne & Schwab

(57) ABSTRACT

A magazining device (2) for a power tool (4) for driving in fastening elements includes a guide member (6) mountable on the power tool (4) coaxially with the drive-in axis (A), a receiving device (8) projecting from the guide member (6) and having a free receiving cross-section (30) for receiving a support strip (32) with the fastening elements (34), a transporting slide (40) spring-biased along a transporting slide guide (50), which is provided in the receiving device (8), in a direction toward the outlet opening (28) of the receiving cross-section (30) and having a bearing element (44) which extends, in a transporting position of the transporting slide (4), into the receiving cross-section (3) for transporting the fastening elements (34) in a direction toward the drive-in axis (A), with the transporting slide (40) having an open position in which the bearing element (44) opens the receiving cross-section (30) in a direction of a lead-in opening (58), and an element for retaining the transporting slide (40) in a spaced relationship with respect to the receiving cross-section (30) in open position of the transporting slide (40).

6 Claims, 4 Drawing Sheets

4
A
12
2
18
6
16
III,IV
10
20
8
38
22
14
III,IV
26
E
10
30
40

MAGAZINING DEVICE FOR A DRIVE-IN POWER TOOL

BACKGROUND OF THE INVENTION

1. Field of the Invention

The present invention relates to a magazining device for a power tool for driving in fastening elements and having a drive-in axis, with the magazining device including a guide member mountable on the power tool coaxially with the drive-in axis, a receiving device projecting from the guide member and having a free receiving cross-section for receiving a support strip with the fastening elements, a locking device operable by the control means which is provided on the guide member and is displaceable between a release position in which it does not block outlet opening of the receiving cross-section and a locking position in which it blocks the outlet opening, a transporting slide spring-biased along a transporting slide guide, which is provided in the receiving device, in a direction toward the outlet opening and having a bearing element which extend, in a transporting position of the transporting slide, into the receiving cross-section for transporting the fastening elements in a direction toward the drive-in axis, with the transporting slide having an open position in which it is secured with respect to the transporting slide channel and in which the bearing element opens the receiving cross-section in a direction of a lead-in opening.

2. Description of the Prior Art

Power tools with a magazining device described above permit to drive in a large number of fastening elements in a short time. The transportation and separation of fastening elements is effected by cooperation of the transporting slide and the locking device. The locking device is brought in its release and locking positions, respectively by displaceable control means when during a setting process, a guide member of the power tool is pressed against a to-be-treated workpiece. Simultaneously, a constant biasing force is applied to the fastening element by the transporting slide that displaces the fastening element in a direction toward the guide member in the release position of the locking device. In the open position of the transporting slide, it is possible to displace a fastening element out of the receiving device in a direction opposite the transportation direction of the fastening elements toward the guide member.

German Publication DE 197 07 235 discloses a magazine for fastening elements in which the transporting slide is secured on the transporting slide guide in its open position. To this end, a two-arm lever is provided on the transporting slide, with a first arm of the lever being hooked in a corresponding recess in a slide wall of the receiving cross-section. Simultaneously, the second arm is pivoted out of the receiving cross-section by bearing means formed of transporting pawls.

The drawback of the magazine or the magazining device of DE 197 07 235 consists in that the construction due to the use of a two-arm lever, is relatively expensive. In addition, with the magazine occupying a release position, fastening elements cannot be reliably retained in the receiving cross-section.

Accordingly, an object of the present invention is to provide a magazining device in which the above-mentioned drawbacks are eliminated, and fastening elements are reliably retained in the receiving cross-section.

SUMMARY OF THE INVENTION

This and other objects of the present invention, which will become apparent hereinafter, are achieved by providing means for retaining the transporting slide in its open position in a spaced relationship with respect to the receiving cross-section.

With the retaining means, the transporting slide, together with the bearing element, is completely removed from the receiving cross-section, so that the receiving cross-section is open in the direction of the lead-in opening. The bearing element can be immovably held on the transporting slide, which substantially simplifies the construction of the transporting slide and of the entire magazining device. In the transporting position of the transporting slide, the bearing element extends into the receiving cross-section and insures a stable transmission of a force from the transporting slide to the fastening element. Furthermore, in the transporting position of the transporting slide, an undersizable falling out of a fastening element from the lead-in opening is reliably prevented.

Advantageously, the retaining means includes an extension provided on the transporting slide guide with respect to the receiving cross-section at an end of the transporting slide guide remote from the outlet opening of the receiving cross-section. This permits to displace the transportating slide away from the guide member over the lead-in opening of the receiving cross-section. Simultaneously, the bearing element is removed from the receiving cross-section. With an appropriate extension of the transporting slide guide, a particularly simple construction of the magazining device is achieved.

Advantageously, the receiving cross-section has, in a region of the lead-in opening, a lead-in section extending toward the lead-in opening away from the transporting slide guide. With an appropriate deflection of the lead-in section from the transporting slide guide, the transporting slide can be spaced from the receiving cross-section by a very small distance. This would minimize the space necessary to insure an appropriate spacing of the slide from the receiving cross-section.

Advantageously, the transporting slide is spring-biased in a direction to its open position. This insures a stable retention of the transporting slide in the open position and disturbance-free loading and unloading of the receiving cross-section with fastening elements.

According to a particularly advantageous embodiment of the present invention, there is provided scroll spring means for biasing the transporting slide. In addition, the retaining means has a curve provided at an end of the transporting slide guide remote from the outlet opening of the receiving cross-section and having a reversal point. The scroll spring means biases the transporting slid in a direction of its open position when the transporting slide is located, at its space position with respect to the receiving cross-section, at a point of the curve located outwardly of the reversal point with respect to the outlet opening of the receiving cross-section. With the scroll spring means, both the biasing force necessary for transporting the fastening elements to the outlet opening and a force for biasing the transporting slides to its open position are produced by the same spring means. The selection between the biasing directions of the scroll spring means is effected by positioning of the transporting slide with respect to the reversal point of the transporting slide guide. This insures a particularly simple and convenient switching between the transporting and open positions of the transporting slide.

Further, the magazining device has means for releasably connecting the receiving device with the power tool, with the locking device automatically blocking the receiving cross-section in a release position of the magazining device. In this way, the bearing element blocks the lead-in opening of the receiving cross-section, and the locking device blocks the outlet opening of the receiving cross-section. In this way, the receiving device can also be removed from the power tool when it is still filled with fastening elements, without a danger of the fastening elements falling out.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
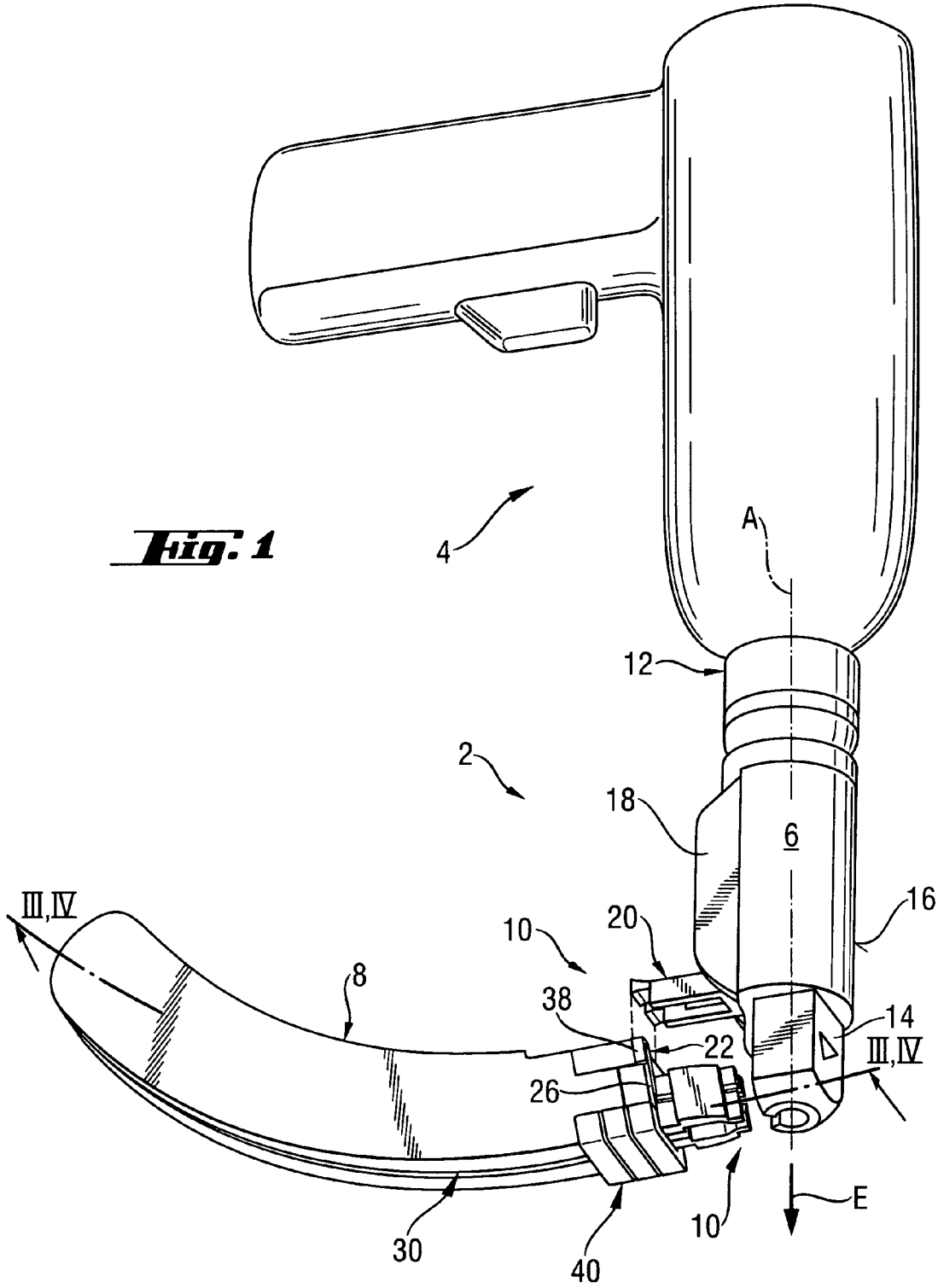
FIG. 1 a side view of a magazining device according to the present invention with a released receiving device.

FIG. 1 shows a magazining device 2 according to the present invention which is mounted on a schematically shown drive-in power tool 4 formed as a screw-driving tool, e.g., as accumulator-driven screw driving tool. The magazining device 2 consists essentially of a sleeve-shaped guide member 6 and a receiving device 8 which project from the guide member 6. The guide member 6 and the receiving device 8 are connected with each other by a releasable connection device 10 which is shown in FIG. 1 in its release condition.

The guide member 6 is secured on the drive-in power tool 4 with a connection sleeve 12. At its end facing in the drive-in direction E, the guide member 6 has a stop element 14 telescopically received in the guide member 6. On the outer side 16 of the guide member 6, there is provided control means 18 in form of a stop rib.

The receiving device 8 is displaceably connected with the stop element 14 by the connection device 10. To this end, the stop element 14 is connected with a support element 20 that projects sidewise from the guide member 6, with the receiving device 8 being pushed on the support element 20 in a region of a locking device 22.

Figure 2:
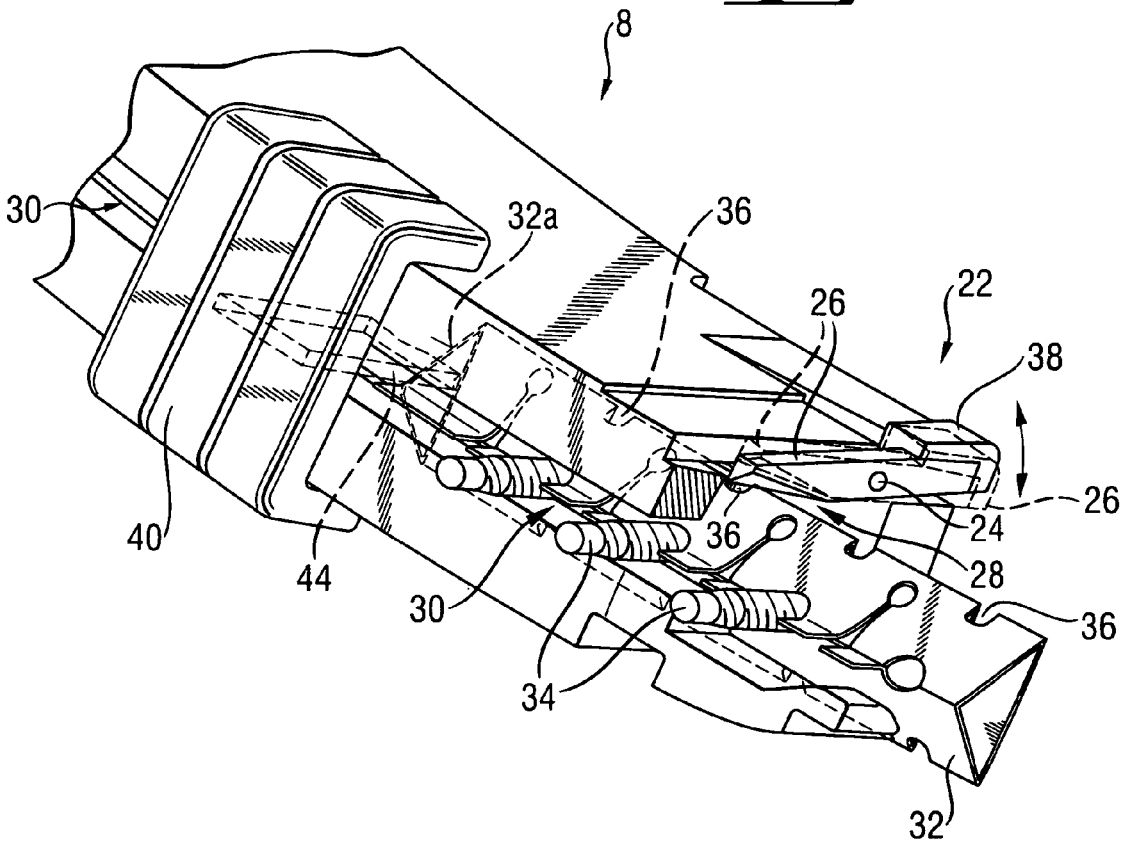
FIG. 2 a perspective partial view of the receiving device with a cut-out showing the outlet opening of the receiving device in a condition when the device is filled with fastening elements.

The locking device 22 has, as it is particularly shown in FIG. 2, a locking pawl 26 pivotable about an axle 24. The receiving device 8 is partially secured with the locking pawl 26 that extends into an outlet opening 28 of a receiving channel having a receiving cross-section 30, with a support strip 32 with fastening elements 34 being held in the receiving channel. In a locking position of the locking pawl 26, which is shown in FIG. 2, it engages in one of a plurality of engagement recesses 36 provided on the support strip 32. The locking pawl 26 is provided with an actuation element 38. Upon application of pressure to the actuation element 38, the locking pawl 26 is brought into its release position in which the support strip 32 can be displaced through the outlet opening 28 and a fastening element 34 is released.

Figure 3:
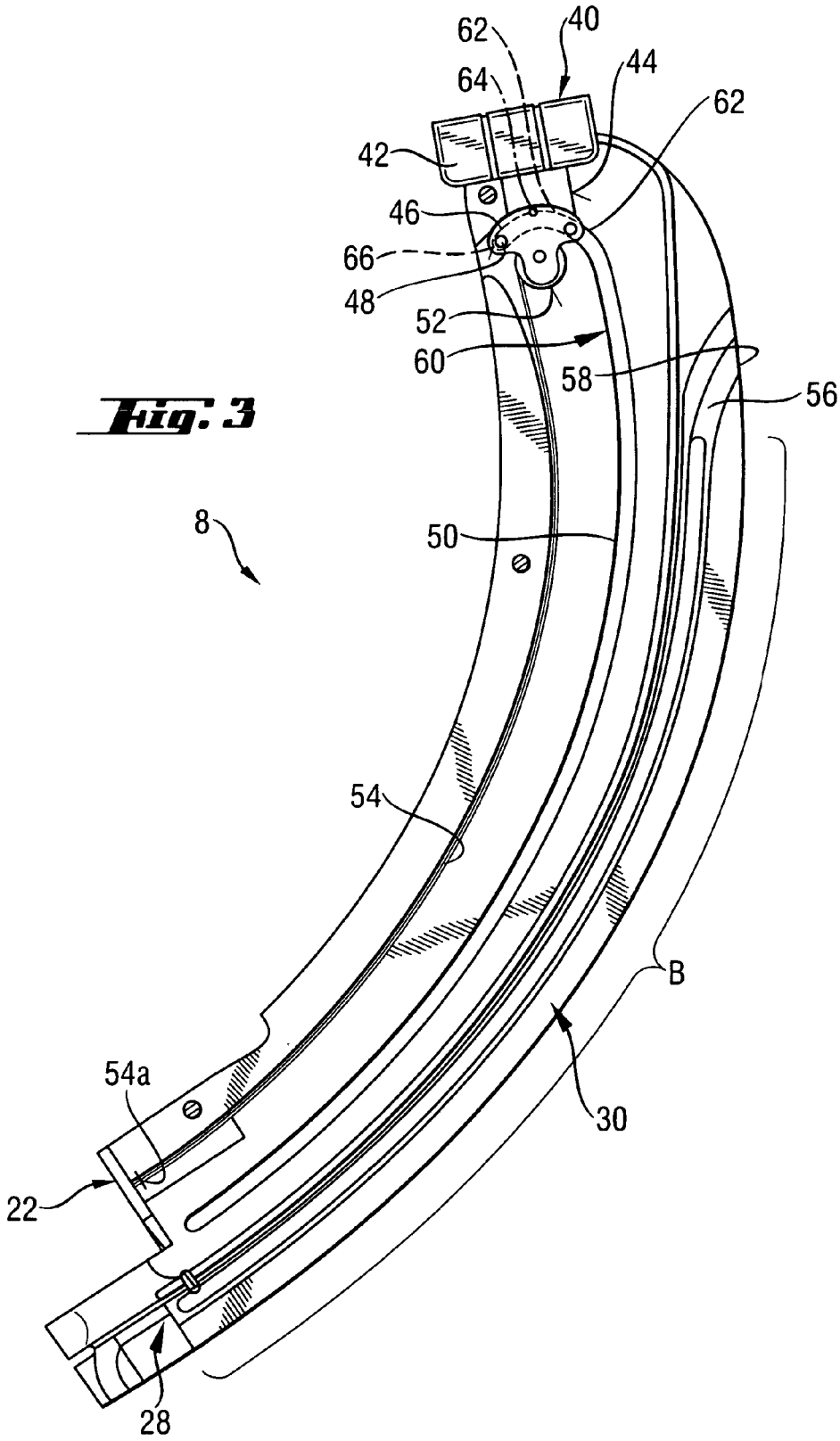
FIG. 3 a cross-sectional view along line III-III in FIG. 1 of the receiving device with the transporting slide in its open position.
Figure 4:
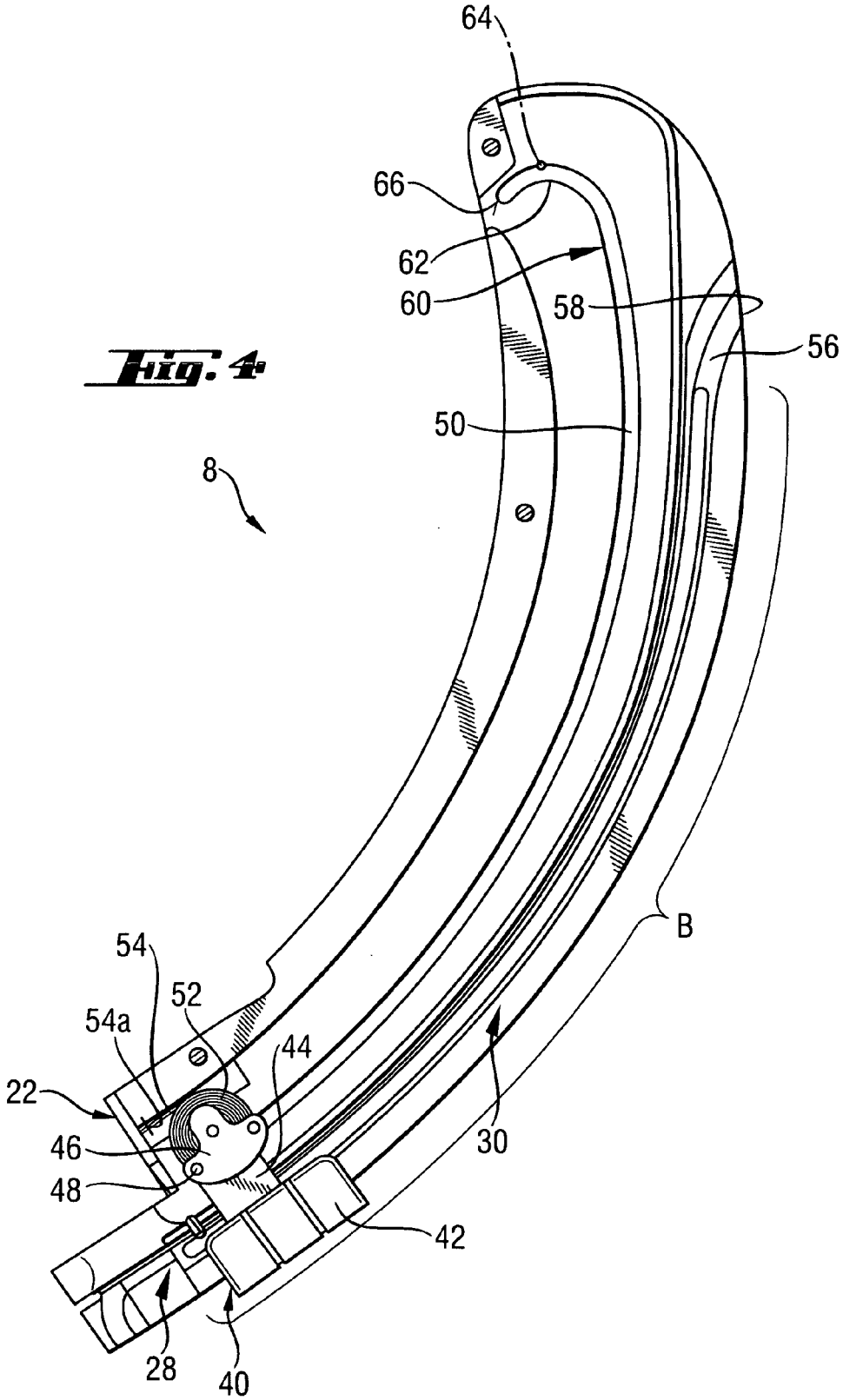
FIG. 4 a cross-sectional view along line IV-IV in FIG. 3 with the transporting slide at the end position of its transporting position.

For displacing the support strip 32 in the direction of the outlet opening 28, there is provided a transporting slide 40, as particularly shown in FIGS. 3-4. For a better clarity, the transporting slide 40 is sown on the receiving device 8 shown in a longitudinal view. The transporting slide 40 has an actuation member 42 displaceable along an outer side of the receiving device 8 so that it can be actuated from outside. A web, which is formed as bearing means 44, connects the actuation member 42 with a scroll spring device 46 two pins 48 of which engage in a groove-shaped transporting slide guide 50 of the receiving device 8.

The scroll spring device 46 further includes a coiling drum 52 for winding and unwinding a tension band 54 the free end 54*a* of which is secured in the region of the outlet opening 28.

As further shown in FIGS. 3-4, the receiving cross-section 30 is provided over almost entire length B parallel to the transporting slide guide 50. At its end remote from the outlet opening 28, the receiving cross-section has a lead-in section 56 that is turned away from the transporting slide guide 50 in the direction of a lead-in opening 58.

As particularly shown in FIG. 4, the transporting slide guide 50 has, in the region of the lead-in opening 58 and with respect to the receiving cross-section 30, an extension 60 that passes, at an end of the transporting slide guide 50 remote from the outlet opening 28, into a sharp curve 62. On the curve 62, there is provided a phantom reversal point 64. In case the transporting slide 40 is displaced past the reversal point 64 in a direction away from the outlet opening 28, the transporting slide 40 will be displaced toward an end stop 66 of the curve 62 and preloaded there against by the scroll spring device 46.

In this position, the transporting slide 40 is in its open, with respect to the receiving cross-section 30, position, as shown in FIG. 3. In this open position, the support strip 32, together with the fastening elements 34, can be fed to the receiving cross-section 30 of the receiving device 8.

Finally, the transporting slide 40 is displaced away from the end stop 66 and over the reversal point 64. Thereby, the transporting slide 40 is brought into its transporting position, shown in FIG. 2, in which it is preloaded on the tension band 54 in the direction of the outlet opening 28 by the scroll spring device 46. The transporting slide 40 applies pressure to the support strip 32 via the bearing means 44, displacing the support strip 32 in the direction of the outlet opening 28.

Because of the connection of the receiving device 8 with the stop element 14 of the guide member 6, no drive-in process can take place until the stop element 14 is pressed against a to-be-treated workpiece (not shown) and, as a result, is displaced into the guide member 6. Simultaneously, the receiving device 8 is displaced toward the guide member 6. As a result of the displacement of the receiving device 8, the actuation member 38 of the locking device 22 is pressed by the control means 18, which results in a pivotal movement of the locking pawl 26 about the axle 24, whereby the outlet opening 28 becomes open.

Because the support strip 32 is displaced by the transporting slide 40 in the direction toward the outlet opening 28, it is displaced in the receiving cross-section 30 until the first fastening element 34 is located along a drive-in axis A of the drive-in power tool 4.

After the first fastening element 34 is driven in the power tool 4 is lifted of the workpiece. Simultaneously, the stop element 14 is displaced out of the guide member 6, and the locking pawl 26 moves away from the control means 18. As a result, the locking pawl 26 again pivots about the axle 24 into its locking position, engaging in the next engagement recess 36 of the support strip 32 and preventing further displacement of the support strip 32.

In this way, the driving-in processes can be effected in short intervals. As soon as all of the fastening elements 34 on the support strip 32 are consumed, the transporting slide 40 is brought with the actuation member 42 past the extension 60 and the reversal point 64 outwardly into the open position (FIG. 3). The receiving cross-section 30 can be filled with a new support strip, as the cross-section 30 is not blocked any more by the transporting slide 40.

In addition, it is possible to disengage a still filled, receiving device 8 from the guide member 6, e.g., to replace it with another receiving device 8 with different fastening elements.

In this release position of the receiving device, the locking device 22 at the outlet opening 28 and the transporting slide 40, which occupies its transporting position, prevent falling the fastening elements 34 out of the receiving device 8.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A magazining device (2) for a power tool (4) for driving in fastening elements (34) and having a drive-in axis (A), the magazining device (2) comprising a guide member (6) mountable on the power tool (4) co-axially with the drive-in axis (A); a receiving device (8) projecting from the guide member (6) and having a free receiving cross-section (30) for receiving a support strip (32) with the fastening elements (34), a locking device (22) operable by a control means (18) which is provided on the guide member (6) and displaceable between a release position in which the locking device does not block an outlet opening (28) of the receiving cross-section (30), and a locking position in which the locking device blocks the outlet opening (28), a transporting slide (40) spring-biased along a transporting slide guide (50), which is provided in the receiving device (8), in a direction toward the outlet opening (28) and having bearing means (44) which extend, in a transporting position of the transporting slide (40), into the receiving cross-section (30) for transporting the fastening elements (34) in a direction toward the drive-in axis (A), the transporting slide (40) having an open position in which the transporting slide is secured with respect to the transporting slide channel (50) and in which the bearing means (44) opens the receiving cross-section (3) in a direction of a lead-in opening (58); and means for retaining the transporting slide (40) in a spaced relationship with respect to the receiving cross-section (30) in open position of the transporting slide (40).

2. A magazining device according to claim 1, wherein the retaining means comprises an extension (60) provided on the transporting slide guide (50) with respect to the receiving cross-section (30) at an end of the transporting slide guide (50) remote from the outlet opening (28) of the receiving cross-section (30).

3. A magazining device according to claim 1, wherein the receiving cross-section (30) has, in a region of the lead-in opening (58), a lead-in section (56) extending toward the lead-in opening (58) away from the transporting slide guide (50).

4. A magazining device according to claim 1, further comprising means for biasing the transporting slide (40) in the open position thereof.

5. A magazining device according to claim 1, further comprising scroll spring means (46) for biasing the transporting slide (40), wherein the retaining means comprises a curve (62) provided at an end of the transporting slide guide (50) remote from the outlet opening (28) of the receiving cross-section (30) and having a reversal point (34), and wherein the scroll spring means (46) biases the transporting slide (40) in a direction of the open position thereof when the transporting slide (40) is located at a spaced position thereof with respect to the receiving cross-section (30), at a point of the curve (62) located outwardly of the reversal point (64) with respect to the outlet opening (28) of the receiving cross-section (30).

6. A magazining device according to claim 1, further comprising means for releasably connecting the receiving device (8) with the power tool (4), and wherein the locking means (22) blocks the receiving cross-section in a release position of the receiving magazine (8).

* * * * *